US010366813B2

(12) United States Patent
Moosheimer

(10) Patent No.: US 10,366,813 B2
(45) Date of Patent: Jul. 30, 2019

(54) HIGH-PRECISION ADDITIVE FORMATION OF ELECTRICAL RESISTORS

(71) Applicant: Hochschule für angewandte Wissenschaften München, München (DE)

(72) Inventor: Ulrich Moosheimer, Hohenkammer (DE)

(73) Assignee: Hochschule für angewandte Wissenschaften München, München (DE)

( * ) Notice: Subject to any disclaimer, the term of this patent is extended or adjusted under 35 U.S.C. 154(b) by 0 days.

(21) Appl. No.: 16/114,327

(22) Filed: Aug. 28, 2018

(65) Prior Publication Data

US 2019/0066889 A1 Feb. 28, 2019

(30) Foreign Application Priority Data

Aug. 28, 2017 (EP) ..... 17188183

(51) Int. Cl.
*H01C 17/065* (2006.01)
*H01C 1/142* (2006.01)
(Continued)

(52) U.S. Cl.
CPC ..... *H01C 17/0652* (2013.01); *H01C 1/142* (2013.01); *H01C 7/003* (2013.01); *H01C 7/006* (2013.01); *H01C 17/006* (2013.01); *H01C 17/065* (2013.01); *H01C 17/075* (2013.01); *H01C 17/281* (2013.01); *H01C 17/283* (2013.01)

(58) Field of Classification Search
CPC .. H01C 17/0652; H01C 17/283; H01C 1/142; H01C 7/003
See application file for complete search history.

(56) References Cited

U.S. PATENT DOCUMENTS 3,512,115 A * 5/1970 Solow ..... H01C 1/16 338/195
3,555,485 A * 1/1971 Solow ..... H01C 1/14 338/252
(Continued)

FOREIGN PATENT DOCUMENTS

JP S6433904 2/1989
JP H04177706 6/1992
(Continued)

OTHER PUBLICATIONS

European Patent Office, European Search Report, EP 17188183.2; dated Mar. 20, 2018. 9 pages.

*Primary Examiner* — Kyung S Lee
(74) *Attorney, Agent, or Firm* — Sunstein Kann Murphy & Timbers LLP

(57) ABSTRACT

Shown herein is a method of forming an electrical resistor comprising the steps of: forming an electrically resistive layer on a substrate; measuring an electrical resistance-related parameter of the electrically resistive layer and determining a target length of the electrically resistive layer corresponding to a target electrical resistance; and forming first and second electrically conductive terminals contacting the electrically resistive layer, said first and second electrically conductive terminals being separated by a distance corresponding to the target length.

25 Claims, 8 Drawing Sheets

(51) Int. Cl.

| | |
|---|---|
| ***H01C 17/00*** | (2006.01) |
| ***H01C 7/00*** | (2006.01) |
| ***H01C 17/28*** | (2006.01) |
| ***H01C 17/075*** | (2006.01) |

(56) References Cited

U.S. PATENT DOCUMENTS

| | | | | |
|---|---|---|---|---|
| 5,514,974 | A * | 5/1996 | Bouldin | H01L 22/34 324/750.3 |
| 6,166,620 | A * | 12/2000 | Inuzuka | H01C 17/06533 338/308 |
| 6,225,035 | B1 | 5/2001 | Zhang | |
| 7,595,716 | B2 * | 9/2009 | Goto | H01C 7/003 338/213 |
| 8,284,017 | B2 * | 10/2012 | Hakey | H01C 3/12 257/327 |
| 2005/0082648 | A1 * | 4/2005 | Naito | C03C 14/004 257/678 |
| 2005/0225424 | A1 | 10/2005 | Tsukada | |
| 2006/0097340 | A1 | 5/2006 | Tsukda | |
| 2014/0049358 | A1 | 2/2014 | Kim | |
| 2016/0027562 | A1 | 1/2016 | Feng | |
| 2016/0133362 | A1 | 5/2016 | Tsuda | |

FOREIGN PATENT DOCUMENTS

| | | |
|---|---|---|
| JP | H097809 | 1/1997 |
| WO | WO 2010/055841 | 5/2010 |

* cited by examiner

HIGH-PRECISION ADDITIVE FORMATION OF ELECTRICAL RESISTORS

FIELD OF THE INVENTION

The present invention is in the field of the manufacturing of electronic components. In particular, the present invention relates to the manufacturing of electrical resistors having a precise electrical resistance by means of additive technologies.

BACKGROUND OF THE INVENTION

An electrical resistor is a passive two-terminal electrical component mainly characterised by its electrical resistance as a circuit element. Electrical resistors are ubiquitously employed in electronic circuits for dividing voltages and adjusting current intensity and signal levels, among other uses. Thus, the reliability and utility of an electrical resistor strongly depends on the accuracy of its electrical resistance value, that is, the precision to which the value of the true electrical resistance thereof, that can be measured, e.g. by means of an ohmmeter, coincides with a nominal electrical resistance value aimed at when manufacturing the electrical resistor.

Electrical resistors typically comprise an electrically resistive element extending between two electrically conductive terminations, wherein the value of the electrical resistance is determined by a cross-section of the electrically resistive element and its length extending between the two electrically conductive terminations as well as the conductivity of the electrically resistive material the electrically resistive element is made of. Imprecisions in the cross-section or the length of the electrically resistive element between the electrically conductive terminations may hence result in a deviation from the nominal value of the electrical resistance of the electrical resistor.

The electronics industry calls for electronic components of increasingly reduced size. This considerably adds to the technical complexity of the manufacturing of electrical resistors with a reliably determined electrical resistance value. Since the electrical resistance of an electrical resistor is closely related to the geometrical dimensions thereof, a precise control of the electrical resistance of an electrical resistor requires a highly accurate definition of its size during a manufacturing process thereof. However, the use of high precision methods for determining the size of electrical resistors at industrial level remains incompatible with the required production yields necessary for ensuring economic viability in the production.

A well-established solution relies on a combined use of less precise and less costly deposition processes for defining the basic structure of an electrical resistor, like for example screen printing, with a subsequent fine adjustment or trimming of the dimensions of the electrically resistive element between the electrically conductive terminals by means of more precise, though necessarily more technically involved and costly subtractive technologies, like laser ablation. According to this solution, a screen template or mask is employed for a preliminary formation of the electrically resistive element, whereupon the electrically conductive terminals are formed and laser trimming is used for accurately determining the shape and dimensions of the electrically resistive element, in particular its length extending between the electrically conductive terminals, and thereby fine tuning the final electrical resistance value of the electrical resistor.

An alternative to laser trimming as subtractive technique used for finely adjusting the dimensions of an electrically resistive element is disclosed in U.S. Pat. No. 6,225,035 B1, according to which an electrically resistive element is formed of a sensitive material allowing for subsequent subtractive treatment by means of photolithography.

While using subtractive methods of the type described above allows for obtaining an electrical resistance value with a desired precision, they tend to increase the manufacturing costs and manufacturing time. On the other hand, when using purely additive technologies, so far the achievable precision is not sufficient for many purposes, such as for example for use as an electrical pre-resistor of an LED.

Thus, there is room for technical improvement in the manufacturing of electrical resistors, in particular concerning the ability to guarantee a high degree of accuracy of the electrical resistance value while maintaining the technical and economic viability of the employed manufacturing methods.

SUMMARY OF THE INVENTION

The problem underlying the invention is to provide for the manufacturing of an electrical resistor having a desired electrical resistance with high precision while ensuring a high production yield and favorable production costs. This problem is solved by the methods according to claims 1 and 2 and by the arrangements according to claims 17 and 18. Preferred embodiments of the invention are defined in the dependent claims.

One aspect of the invention concerns a method of forming an electrical resistor having a target electrical resistance by additive manufacturing. The method comprises a step of forming an electrically resistive layer on a substrate. Herein a "substrate" refers to any element that may serve as a supportive basis for the formation of a layer on it, for example a silicon, polymer, or ceramic substrate, a printed circuit board (PCB), paper, cardboard or any dielectric or organic layer, which may or may not be included in a multilayer circuit. The electrically resistive layer may be formed to have a regular shape, preferably the shape of a rectangular cuboid or stripe defined by three dimensions, length, width and thickness, wherein the width and the thickness are significantly shorter than the length and define a cross-section of the electrically resistive layer. This suppresses variabilities in the electrical resistance of the electrical resistor and allows for a high accuracy of the final electrical resistance. Accuracies below 1%, even 0.01% or lower may be achieved. Note, however, that other shapes of the electrically resistive layer are also possible. In particular the electrically resistive layer may have an irregular shape, swerving lines, or a curved shape.

The method further comprises a step of measuring an electrical resistance-related parameter of the electrically resistive layer and determining from the electrical resistance-related parameter a target length of the electrically resistive layer corresponding to the target electrical resistance. The electrical resistance-related parameter may be measured along an electrical path through the electrically resistive layer having a length L. An electrical resistance R measured along said electrical path is then given by $$R = \rho \frac{L}{A}, \tag{1}$$

wherein ρ is the electrical resistivity of the electrically resistive layer, and A is a cross-section of the electrically resistive layer. The measured electrical resistance-related parameter may be, for example, any quantity indicative of the ratio of the electrical resistance of a portion of the electrically resistive layer in which the electrical resistance is measured to the length of said portion, R/L. The electrical resistance-related parameter may then hence account for the cross section A and the electrical resistivity ρ.

However, the electrical resistance-related parameter may also correspond to other physical properties of the electrically resistive layer that may be related to the electrical resistance thereof, like for example geometrical dimensions, e.g. a thickness, a width, or a cross-section of the electrically resistive layer, optical properties, or to a transmittance, a transmission coefficient, a reflectance, a reflection coefficient, an absorbance, an absorption coefficient or the like with respect to e.g. photons, electrons, ions or any particles suitable for measuring.

The electrically resistive layer may have a regular shape, like e.g. a stripe-shape, having a longest dimension. In this case, the electrical path may correspond to a straight electrical path extending along a first direction coinciding with a direction along which said longest dimension of the electrically resistive layer, for instance its length, extends. However, the electrically resistive layer may have a curved, irregular or folded shape, in which case the electrical path may correspondingly have a curved, irregular or folded shape.

Thus, the measurement of the electrical resistance-related parameter allows using a desired target electrical resistance as an input variable for determining a target length that, in view of the aforesaid electrical resistance to length ratio, corresponds to the target electrical resistance. Since the measurement of the electrical resistance-related parameter is carried out after the formation of the electrically resistive layer, it provides an accurate realistic value of the aforesaid electrical resistance to length ratio.

The measurement may be performed using any suitable piece of equipment, such as a multimeter or an ohmmeter, possibly connected to a processing unit, in a manner known and available to those skilled in the art.

It is noteworthy that, although constant values of the electrical resistivity and the cross-section have been assumed in the foregoing description, the present method may be adapted to the case of an electrically resistive layer having an inhomogeneous electrical resistivity and/or a variable cross-section in a manner readily accessible to those skilled in the art. Further, the parameters present in equation (1), or related parameters may be used in any way mathematically equivalent to that described above allowing for the determination of a quantity indicative of the ratio of the electrical resistance of a portion of the electrically resistive layer in which the electrical resistance is measured to the length of said portion.

The method further comprises a step of forming a first electrically conductive terminal and a second electrically conductive terminal such as to contact the electrically resistive layer, said first and second electrically conductive terminals being separated by a distance corresponding to the target length, such that an electrical resistance of a portion of the electrically resistive layer extending between the first electrically conductive terminal and the second electrically conductive terminal corresponds to the target electrical resistance.

Note that in some embodiments, the electrically resistive layer is formed first, and thereafter, the first and second conductive terminals are formed on said electrically resistive layer such as to contact the same. Examples of this order of method steps are presented in detail below. However, it is likewise possible that first only one of the first and second electrically conductive terminals is provided, and that only thereafter the electrically resistive layer is formed such that it is in contact with the present electrically conductive terminal. Accordingly, in the present disclosure, the phrase "forming an electrically conductive terminal such as to contact the electrically resistive layer" shall be understood to include the situation in which the electric conductive terminal is formed first, and the electrically resistive layer is formed to be in contact with this electrically conductive terminal afterwards. After measuring the electrical resistance-related parameter of the electrically resistive layer and determining the target length, the other of the first and second electrically conductive terminals may be formed such as to be separated by the target length from the electric conductive terminal that was formed first.

More generally, it is to be understood that the order in which method steps are mentioned in the present claims and description does not imply that they are necessarily carried out in this order. Instead in the present disclosure, all technically possible orders of the mentioned method steps are likewise considered.

It is further worth noticing that the aforesaid "distance" between the first and second electrically conductive terminals is not necessarily an Euclidean, i.e. straight, distance between the first and second electrically conductive terminals. The aforesaid distance may correspond to an Euclidean distance between the first and second electrically conductive terminals in cases in which the electrically resistive layer has a regular shape, like e.g. a stripe-shape, having a longest dimension. In cases in which the electrically resistive layer has a curved, irregular or folded shape, however, the aforesaid distance refers to a distance along the electrical path through the electrically resistive layer between the first electrically conductive terminal and the second electrically conductive terminal.

A precise positioning of the first electrically conductive terminal and the second electrically conductive terminal on/with respect to the electrically resistive layer, such that they are separated by a distance accurately corresponding to the target length, allows for a likewise precise determination of the effective geometrical dimensions of a portion of the electrically resistive layer extending between the first electrically conductive terminal and the second electrically conductive terminal.

The precise positioning of the first and second electrically conductive terminals may for example be achieved by means of digital printing. Using a digital printing technology, the printing geometry can be adjusted automatically according to the measured electrical resistance-related parameter. For example, for a rectangular electrically resistive layer, the distance between the electrically conductive terminals may be adjusted by digital printing according to printing control information comprising the target length. An accuracy of 10% can easily be achieved. A high ratio of length to height of the rectangular electrical resistor allows high accuracy of the final electrical resistance value below 1%, even 0.01% or lower.

The precise positioning of the first and second electrically conductive terminals may alternatively be achieved by means of analog printing, like screen printing. In this case, firstly the electrically conductive terminal is printed, and secondly the electrically conductive layer is printed. Then, the electrical resistance-related parameter is measured and the target length is determined, so that the exact required position of the second electrically conductive terminal with respect to the first electrically conductive terminal can be determined. This information about said required position may allow a processing unit controlling the screen printing operation to shift the screen to the right position. A similar procedure may be applied to other analog printing technologies such as gravure printing, flexo printing, pad printing, thermo transfer printing and hot stamping. An accuracy of 15% can thereby be easily achieved. More sophisticated printing equipment allows a more accurate placing of the second electrically conductive terminal and an accuracy of 2% or lower can be achieved.

The method of the invention described above allows manufacturing an electrical resistor with high reliability concerning a real, i.e. measurable, value of the electrical resistance thereof in a way that may benefit from the high accuracy of modern additive manufacturing processes, like for example digital inkjet printing, for positioning the first electrically conductive terminal and the second electrically conductive terminal on/with respect to the electrically resistive layer with high spatial accuracy, such that their mutual separation precisely corresponds to the target length defined by the target electrical resistance. Precisely positioning the first and second electrically conductive terminals hence ensures that the electrical resistance of the portion of the electrically resistive layer extending between the first and second electrically conductive terminals precisely corresponds to the target electrical resistance. Any imprecisions in the formation of the electrically resistive layer with regard to its cross-section or electrical resistivity ρ can therefore be compensated afterwards by properly choosing the target length, which is in turn based on the measurement of the electrical resistance-related parameter of the electrically resistive layer including all possible imprecisions. The only manufacturing step that actually needs to be carried out with high precision is the formation of the first and second electrically conductive terminals, which can be done comparatively easily and cost efficiently.

An accurate positioning of the first electrically conductive terminal and the second electrically conductive terminal such that the distance between them precisely corresponds to the target length may be achieved, for instance, by means of a correspondingly designed software tool running on a processor that is operatively connected to a device with which the first and second electrically conductive terminals can be formed on/with respect to the electrically resistive layer. Further, such a processor may be operatively connected to an optical measurement device, like a camera device, configured for monitoring an operation of the device. Details on corresponding arrangements for manufacturing an electrical resistor will be explained below with respect to further aspects of the present invention.

A second aspect of the invention is related to a method of forming an electrical resistor having a target electrical resistance by additive manufacturing. This method also comprises steps of forming an electrically resistive layer on a substrate and of measuring an electrical resistance-related parameter of the electrically resistive layer and determining from the electrical resistance-related parameter a target length of the electrically resistive layer corresponding to the target electrical resistance.

However, unlike the method of the first aspect, the method of the second aspect of the invention comprises a step of forming an electrically isolating layer on the electrically resistive layer having first and second ends, wherein the electrically isolating layer covers the electrically resistive layer in an overlap region extending between said first end and said second ends, such that a length of the electrically resistive layer covered by the electrically isolating layer corresponds to the target length, such that an electrical resistance of a portion of the electrically resistive layer covered by the electrically isolating layer corresponds to the target electrical resistance. The electrically isolating layer may be formed to have a regular shape, preferably the shape of a rectangular cuboid or stripe defined by three dimensions, length, width and thickness, wherein the width and the thickness are shorter than the length and define a cross-section of the electrically isolating layer. However, other shapes of the electrically isolating layer are also possible, such as dashed lines. Electrically conductive material printed between the dashes of the electrically isolating layer reduces the final electrical resistance value. This is similar to a sequence of electrical resistors. In particular the electrically isolating layer may have an irregular cross section or a curved cross section.

It is worth noting that the method is not sensitive to the precise thickness, or irregularities in the thickness of the electrically isolating layer, the only requirement being that it is sufficiently electrically isolating.

The method further comprises a step of forming a first electrically conductive terminal on the electrically resistive layer directly adjacent to the first end of the electrically isolating layer and forming a second electrically conductive terminal on the electrically resistive layer directly adjacent to the second end of the electrically isolating layer. The first and second electrically conductive terminals may be respectively in electrical contact with first and second portions of the electrically resistive layer, wherein the first portion of the electrically resistive layer and the second portion of the electrically resistive layer respectively correspond to opposed ends of the electrically resistive layer, wherein the electrically isolating layer overlaps with the electrically resistive layer in an overlap region extending between said first portion of the electrically resistive layer and said second portion of the electrically resistive layer.

According to this method, the measurement of the electrical resistance-related parameter allows using a desired target electrical resistance as an input variable for determining a target length that, in view of the electrical resistance to length ratio of the electrically resistive layer, corresponds to the target electrical resistance. The electrically isolating layer is formed to have precisely the target length and the first electrically conductive terminal and the second electrically conductive terminal are formed on the electrically resistive layer at opposed ends of the electrically isolating layer and respectively adjacent thereto, such that an electrical path between the first electrically conductive terminal and the second electrically conductive terminal extends through the electrically resistive layer and has a length that corresponds to the length of the electrically isolating layer that separates the first electrical contact from the second electrical contact, i.e. corresponds to the target length. This way, an electrical resistance of a portion of the electrically resistive layer overlapping with the electrically isolating layer and hence extending between the first and second electrically conductive terminals corresponds to the target electrical resistance.

According to this method, the first and second electrically conductive terminals are formed on the electrically resistive layer "directly adjacent to the first and second ends of the electrically isolating layer", which in practice can be very easily obtained by forming the electrically conductive terminals such as to overlap with the ends of the electrically isolating layer to some extent. That is to say, while this overlap is of course not necessary, the rationale of forming the electrically isolating layer is to provide for the precise location where the electrically conductive terminals electrically contact the electrically resistive layer, without requiring a correspondingly precise positioning of the electrically conductive terminals themselves. Accordingly, the only method step that needs to be carried out with high precision is the formation of the electrically isolating layer. Manufacturing imperfections e.g. with regard to the cross-section or electrical resistivity ρ of the electrically resistive layer are again absorbed in the proper determination of the target length, and a high precision with regard to forming the electrically conductive terminals is likewise not necessary, since they may simply be formed such as to be in electrical contact or partly overlap with the corresponding end of the electrically isolating layer, which automatically ensures that they are formed on the electrically resistive layer "directly adjacent to" the respective end of the electrically isolating layer.

The method according to this aspect of the invention hence also allows manufacturing an electrical resistor with high reliability concerning a real, i.e. measurable, value of the electrical resistance thereof in a way that benefits from the high accuracy of modern additive manufacturing processes, like for example digital inkjet printing or screen printing, for forming the electrically isolating layer to have a precisely determined length corresponding to the target length, such that the electrical path through the electrically resistive layer between the first electrically conductive terminal and the second electrically conductive terminal has a length that precisely corresponds to the target length defined by the target electrical resistance.

An accurate determination of the dimensions and shape of the electrically isolating layer, in particular of its length, may be achieved, for instance, by means of a correspondingly designed software tool running on a processor that is operatively connected to a device with which the electrically isolating layer can be formed on or attached to the electrically resistive layer. Further, such a processor may be operatively connected to an optical measurement device, like a camera device, configured for monitoring an operation of said device. Details on corresponding arrangements for manufacturing an electrical resistor will be explained below with respect to further aspects of the present invention.

The electrically isolating layer may further improve a thermomechanical stability of the electrical resistor, for example by protecting the substrate on which the electrically resistive layer is formed from unwanted irruptions during subsequent manufacturing processes and from material losses or disruptions like cracks, deformations or bending.

By means of the methods according to the two aspects of the invention described above, an electrical resistor may be manufactured with high accuracy in a comparatively simple and cost efficient manner. In particular, the present invention does not require the use of costly, time-consuming and technically involved subtractive methods for a fine adjustment of the shape and/or dimensions of the electrically resistive element, like for example laser trimming or photolithographic techniques.

In preferred embodiments of the invention shown, the electrical resistance-related parameter may be determined by measuring an electrical resistance of a portion of the electrically resistive layer having a known length. The known length may for example correspond to a fixed, known or measurable distance between two measuring terminals of a measuring device suitable for electrical resistance measurements. However, said known length may also be obtained as a result of a direct length measurement of the distance between two points of the electrically resistive layer. An operation of measuring an electrical resistance of a portion of the electrically resistive layer having a known length for determining the electrical resistance-related parameter may be carried out after or during the formation of the electrically resistive layer.

In preferred embodiments of the invention, the electrically isolating layer may be made of a ceramic, an oxide, preferably silicon oxide, aluminum oxide or metallic oxide, paper or a polymer, preferably an organic polymer. For example, the electrically isolating layer may be of any of PE, PP, PET, OPA, PC or PVC, or paper. The electrically isolating layer may in some embodiments be in the form of an adhesive label or a pressure sensitive label. The electrically isolating layer may have a thickness between 0.01 μm and 600 μm, preferably between 10 μm and 75 μm.

In other preferred embodiments of the invention, forming the electrically isolating layer may comprise analog printing, preferably one or more of screen printing, flexo printing, gravure printing, inkjet printing, pad printing, hot stamping, and thermo transfer printing. This way, electrically isolating layers for different electrical resistors may be provided in a cost-effective and reliable manner allowing for a reduced viability and a high production yield. However, it is likewise possible to employ digital printing for forming the electrically isolating layer, in particular digital inkjet printing or 3-D printing.

According to preferred embodiments of the invention, the electrically isolating layer may be formed by depositing an electrically isolating element on the electrically resistive layer. Note that in the present disclosure, the term "depositing" has a broad meaning, and covers both, the position of material by methods such as chemical vapor deposition or physical vapor deposition, as well as placing a prefabricated element on an underlying layer. The electrically isolating element corresponds to the electrically isolating layer and hence covers the electrically resistive layer in an overlap region extending between a first end and a second end of the electrically isolating element, such that a length of the electrically resistive layer covered by the electrically isolating element corresponds to the target length. This way, an electrical resistance of a portion of the electrically resistive layer covered by the electrically isolating element corresponds to the target electrical resistance. In cases in which the electrically isolating element has a regular shape like e.g. a stripe-shape, having a longest dimension, the electrically isolating element may extend along a first direction aligned with said longest dimension such that the aforesaid overlap region may also have a regular shape. In cases in which the electrically resistive element has a curved, irregular or folded shape, however, the aforesaid overlap region may correspondingly have a curved, irregular or folded shape.

For example, the prefabricated electrically isolating element can be deposited on the electrically resistive layer by means of gluing or bonding. In some embodiments, the prefabricated electrically isolating element may be an adhesive label suitable for being easily attached to the electrically resistive layer. Forming the electrically isolating layer by depositing a prefabricated electrically isolating element allows for a very cost effective manner of forming the electrically isolating layer. The prefabricated electrically isolating element may be formed by analog printing, preferably screen printing on some carrier, from which it can be peeled off prior to depositing it on the electrically isolating layer. However, the prefabricated electrically isolating element may also be formed by flexo printing, gravure printing, pad printing, thermo transfer printing, hot stamping or vaccum coating/evaporation.

According to preferred embodiments of the invention, the method further comprises adjusting the length of the electrically resistive layer covered by the electrically isolating element by positioning the electrically isolating element with respect to the electrically resistive layer. For example, the electrically isolating element may be shifted with respect to the electrically resistive layer along a first direction.

In a preferred embodiment of the invention, forming the first electrically conductive terminal and the second electrically conductive terminal may comprise forming an electrically conductive layer on the electrically isolating layer and extending over the first and second ends of the electrically isolating layer, such as to electrically contact the electrically resistive layer in regions directly adjacent to the first and second ends of the electrically isolating layer, wherein the electrically conductive layer has a discontinuity that separates said electrically conductive layer into electrically isolated first and second electrically conductive terminals. The discontinuity ensures that the first and second electrically conductive terminals are electrically isolated from each other, such that an electrical path between the first electrically conductive terminal and the second electrically conductive terminal extends through the electrically resistive layer, so that an electrical resistance of a portion of the electrically resistive layer extending between the first and second electrically conductive terminals corresponds to the target electrical resistance. The discontinuity may correspond to an opening in the electrically conductive layer that exposes the electrically isolating layer. The discontinuity may for example be formed by interrupting a printing process of the electrically conductive layer. This way, the first electrically conductive terminal and the second electrically conductive terminal may be formed in a single layer formation process step.

In other embodiments, the discontinuity may be formed by separating a previously continuous conducting layer by cutting, etching, laser ablation, or photolithography techniques.

The electrically conductive layer may be made of any of metal, copper, silver, gold, PeDot, carbon, carbon nanotubes, graphene, carbon dioxide treated by reactive drying, aluminum, and indium tin oxide (ITO). The electrically conductive layer may have a thickness between 0.001 μm and 680 μm, preferably between 4 μm and 50 μm.

In preferred embodiments of the invention, the electrically resistive layer may be made of an organic material, preferably of carbon, carbon composites, metal oxides, as tin oxide PeDot and/or mixtures thereof. The electrically resistive layer may have a thickness between 0.01 μm and 600 μm, preferably between 10 μm and 75 μm.

In some preferred embodiments, forming the electrically resistive layer may comprise one or more of printing, coating, vacuum coating, vacuum deposition, curing and drying. For instance, forming the electrically resistive layer may comprise depositing an electrically resistive layer, for example by means of printing, and subsequently drying the deposited electrically resistive layer. The electrically resistive layer may in some embodiments be formed in a multilayer configuration, wherein the electrically resistive layer comprises several layers each of which is formed in a separate formation process. This way, pin holes in the resistive layer can be avoided. For example, the multilayer electrically resistive layer may be printed by printing each of the several layers on top of each other in respective printing operations.

According to preferred embodiments of the invention, forming the first electrically conductive terminal and the second electrically conductive terminal may comprise digital printing, preferably inkjet printing, thermo transfer printing, or 3-D printing. For instance, forming the first electrically conductive terminal and the second electrically conductive terminal may comprise inkjet printing the first electrically conductive terminal and the second electrically conductive terminal or an electrically conductive layer and subsequently drying the first electrically conductive terminal and the second electrically conductive terminal or the electrically conductive layer. This way, the high precision offered by inkjet printing can be used for accurately positioning the first electrically conductive terminal and the second electrically conductive terminal such that an electrical path between them has a length that precisely corresponds to the target length. The first electrically conductive terminal and the second electrically conductive terminal may be formed of any of metal, copper, silver, gold PeDot, carbon, carbon nanotubes, graphene, carbon dioxide treated by reactive drying, aluminum, and indium tin oxide (ITO). The electrically conductive layer may have a thickness of between 0.001 μm and 680 μm, preferably of between 4 μm and 50 μm.

According to preferred embodiments of the invention, the method further comprises a step of measuring a final electrical resistance-related parameter of the electrically resistive layer, wherein the final electrical resistance-related parameter is indicative of an electrical resistance of the electrically resistive layer between the first electrically conductive terminal and the second electrically conductive terminal. This allows obtaining a reliable estimate of the actual electrical resistance value of the electrical resistor formed. Those skilled in the art will readily understand that the electrical resistance-related parameter may correspond to a quantity other than the electrical resistance but related thereto, such as the resistivity, the conductivity and the like, as elucidated above.

According to preferred embodiments of the invention, the method may further comprise an iterative repetition of the method steps of measuring the electrical resistance-related parameter and of forming the first and second electrically conductive terminals. For example, if a measurement of the electrical resistance-related parameter, like the final electrical resistance-related parameter, reveals that the electrical resistance of the electrically resistive layer can more precisely correspond to the target electrical resistance by reducing a current electrical resistance value, prolongations of the first and second electrically conductive terminals may be formed with high precision so as to shorten the distance between them, i.e. the length of an electric path joining the first and second electrically conductive terminals. As a result, the electrical resistance of the electrically resistive layer corresponds to the target electrical resistance with a better accuracy.

In preferred embodiments of the invention, the method may further comprise electrically connecting to the electrically resistive layer between the first and second electrically conductive terminals one or more electrically conductive elements. This way, a current electrical resistance value may be reduced. An electrically conductive element provides for a shortcut and hence for an effective reduction of the length of the electrical path between the first and second electrically conductive terminals that results in a reduction of the "distance" between them and hence in a reduction of the electrical resistance of the electrically resistive layer between the first and second electrically conductive terminals. Consequently, the electrical resistance of the electrically resistive layer corresponds to the target electrical resistance with a better accuracy. The electrically conductive element may be of any of copper, silver, gold, PeDot, carbon, carbon nanotubes, graphene, carbon dioxide treated by reactive drying, aluminum, and indium tin oxide (ITO). In some embodiments, the electrically conductive element may be an adhesive electrically conductive label.

It is possible as well, to measure an electrical resistance-related parameter for a plurality of electrical resistors connected in series or in parallel and adjusting the value of the equivalent electrical resistance by correspondingly adjusting the value of the electrical resistance of one or more of the electrical resistors as explained above.

In preferred embodiments of the invention, the method may further comprise optically monitoring the formation of the first electrically conductive terminal and the second electrically conductive terminal and, if an electrically isolating layer is formed, optically monitoring the formation of the electrically isolating layer. The information obtained from the optical monitoring may be used by a processor to control the operation of forming the first electrically conductive terminal and the second electrically conductive terminal and/or the operation of forming the electrically isolating layer in order to improve the spatial accuracy thereof.

A further aspect of the invention concerns an arrangement for forming an electrical resistor having a target electrical resistance by additive manufacturing according to the methods related to the first aspect of the invention described above. The arrangement comprises a first deposition device configured for depositing an electrically resistive material for forming an electrically resistive layer. The arrangement further comprises a processing unit configured for measuring an electrical resistance-related parameter of an electrically resistive layer formed by the first deposition device and determining from the electrical resistance-related parameter a target length of the electrically resistive layer corresponding to the target electrical resistance. For this purpose, the processing unit may be operatively connected to a measuring device configured for measuring the electrical resistance-related parameter, for example a multimeter, an ohmmeter, or the like. The arrangement further comprises a second deposition device configured for depositing an electrically conductive material for forming electrically conductive terminals, like a first electrically conductive terminal and a second electrically conductive terminal according to the embodiments of the invention described above.

The processing unit is further configured for controlling the second deposition device to form a first electrically conductive terminal and a second electrically conductive terminal such as to contact an electrically resistive layer formed by the first deposition device, and such as to be separated by a distance corresponding to the target length, such that an electrical resistance of a portion of the electrically resistive layer extending between the first electrically conductive terminal and the second electrically conductive terminal corresponds to the target electrical resistance. The first position device and a second deposition device may be comprised in an integrated combined deposition device. Further, the processing unit may comprise a software tool configured for accurately forming the first electrically conductive terminal and the second electrically conductive terminal such that a distance between them precisely corresponds to the target length.

A further aspect of the invention relates to an arrangement for forming an electrical resistor having a target electrical resistance by additive manufacturing according to methods according to the second aspect of the invention described above. The arrangement comprises a first deposition device, a second deposition device, and a processing unit analogous to those of the arrangement previously described. The arrangement further comprises a third deposition device configured for depositing an electrically isolating material for forming an electrically isolating layer. The processing unit is further configured for controlling the third deposition device to form an electrically isolating layer on an electrically resistive layer formed by the first deposition device, such that the electrically isolating layer extends from a first end to a second end, wherein the electrically isolating layer covers the electrically resistive layer in an overlap region extending between said first end and said second end, such that a length of the electrically resistive layer covered by the electrically isolating layer corresponds to the target length. The first deposition device, the second deposition device and/or the third deposition device may be comprised in an integrated combined deposition device.

The processing unit is further configured for controlling the second deposition device to form a first electrically conductive terminal on the electrically resistive layer directly adjacent to the first end of the electrically isolating layer and to form a second electrically conductive terminal on the electrically resistive layer directly adjacent to the second end of the electrically isolating layer. The processing unit may comprise a software tool configured for accurately determining the dimensions and shape of the electrically isolating layer, in particular its length.

In preferred embodiments of the invention, the third deposition device may comprise a robot device configured for depositing a prefabricated electrically isolating element on an electrically resistive layer formed by the first deposition device to act as said electrically isolating layer.

In preferred embodiments of the invention, the third deposition device may comprise a printing device configured for printing the electrically isolating layer by means of analog printing, preferably one or more of screen printing, gravure printing, flexo printing, pad printing, thermo transfer printing and hot stamping.

In other preferred embodiments of the invention, the third deposition device may comprise a printing device configured for printing the electrically isolating layer by means of digital printing, preferably inkjet printing, thermo transfer printing, or 3-D printing.

According to preferred embodiments of the invention, the arrangement further comprises a subtractive device suitable for forming a discontinuity in an electrically conductive layer formed by the second deposition device on the electrically isolating layer, to thereby separate said electrically conductive layer into mutually isolated first and second electrically conductive terminals. The subtractive device may comprise a light source, a laser, a heat source, and/or chemical or mechanical ablation means like a mechanical drill or a mechanical saw.

In preferred embodiments of the invention, the second deposition device comprises a printing device configured for printing the first electrically conductive terminal and a second electrically conductive terminal by means of digital printing, preferably inkjet printing, thermo transfer printing, or 3-D printing.

According to preferred embodiments of the invention, the arrangement may further comprise an optical device configured for optically monitoring the formation of the first electrically conductive terminal and the second electrically conductive terminal by the second deposition device and/or for optically monitoring the formation of the electrically isolating layer by the third deposition device. The optical device may be operatively coupled to the processing unit to provide the processing unit with information related to size and/or positioning of a first electrically conductive terminal and a second electrically conductive terminal or an electrically conductive layer formed by the second deposition device and/or of an electrically isolating layer formed by the third deposition device.

In preferred embodiments of the invention, the arrangement may further comprise a measuring device suitable for measuring an electrical resistance-related parameter of the electrically resistive layer.

DESCRIPTION OF PREFERRED EMBODIMENTS

Certain embodiments of the present invention are described in detail herein below with reference to the accompanying drawings, wherein the features of the embodiments can be freely combined with each other unless otherwise described. However, it is to be expressly understood that the description of certain embodiments is given by way of example only, and that it should not be understood to limit the invention.

Figure 1:
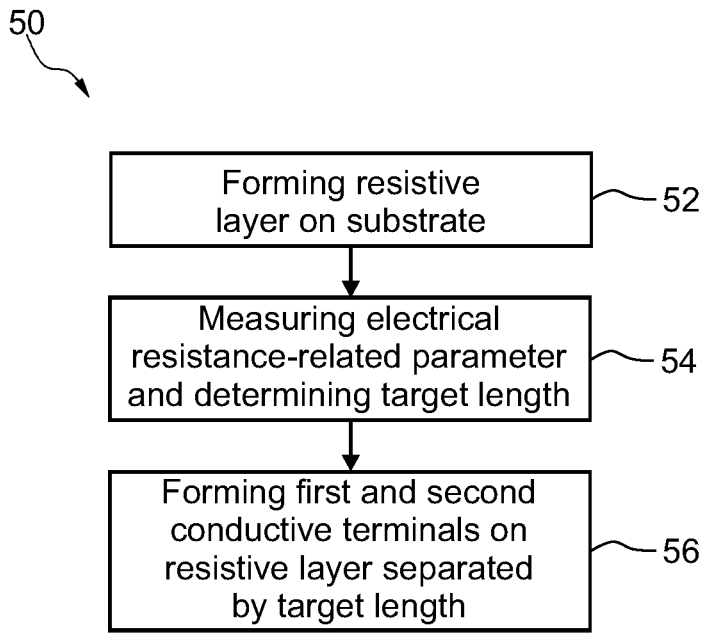
FIG. 1 is a flow diagram representing a method for forming an electrical resistor according to an embodiment of the invention.
Figure 2:
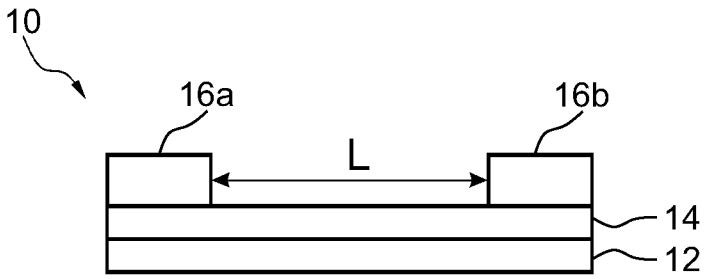
FIG. 2 shows an electrical resistor formed by a method according to an embodiment of the invention.
Figure 3:
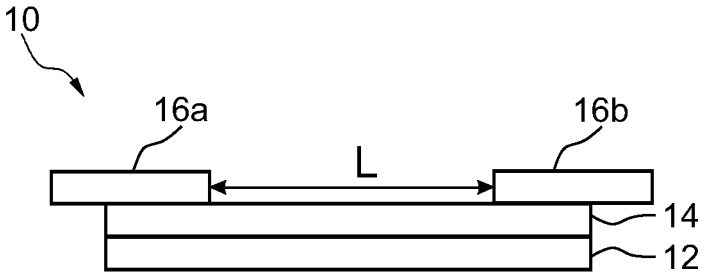
FIG. 3 shows an electrical resistor formed by a method according to an embodiment of the invention.

FIG. 1 is a flow diagram illustrating a method 50 of forming an electrical resistor having a target electrical resistance by additive manufacturing according to an embodiment of the invention. Exemplary electrical resistors to formed by the method 50 illustrated in FIG. 1 are shown in FIGS. 2 and 3. Thus, FIGS. 1 to 3 may be considered in combination for a better understanding of the invention. The method 50 comprises a step 52 of forming an electrically resistive layer 14 on a substrate 12. In the embodiment shown, the step 52 comprises printing an electrically resistive layer 14 of carbon having a thickness of 15 μm on a substrate 12 that corresponds to a PCB of PET having a thickness of 75 μm.

The method 50 further comprises a step 54 of measuring an electrical resistance-related parameter of the electrically resistive layer 14 along a first direction and determining from the electrical resistance-related parameter a target length L of the electrically resistive layer 14 along the first direction corresponding to the target electrical resistance. In FIGS. 2 and 3, the first direction corresponds to a horizontal direction in the paper plane. In the embodiment shown, the electrical resistance-related parameter is determined by measuring the electrical resistance of a portion of the electrically resistive layer 14 having (not shown) a known length, for example a fixed distance between two measuring terminals of a measuring device suitable for electrical resistance measurements. However, said known length may also be obtained as a result of a direct length measurement of the distance between two points of the electrically resistive layer 14 along the first direction at which the electrical resistance-related parameter is measured.

The measurement of the electrical resistance-related parameter allows determining an electrical resistance to length ratio of the electrically resistive layer 14 and hence using a desired target electrical resistance as an input variable for determining, in view of said ratio, a target length L of the electrically resistive layer 14 along the first direction corresponding to the target electrical resistance.

The method 50 further comprises a step 56 of forming a first electrically conductive terminal 16*a* and a second electrically conductive terminal 16*b* on the electrically resistive layer 14 separated by a distance along the first direction corresponding to the target length L. This way, an electrical resistance of a portion of the electrically resistive layer 14 extending between the first electrically conductive terminal 16*a* and the second electrically conductive terminal 16*b* along the first direction corresponds to the target electrical resistance. In the embodiment shown, the first electrically conductive terminal 16*a* and the second electrically conductive terminal 16*b* are inkjet printed on the electrically resistive layer 14 with a high degree of spatial accuracy such that the distance between the first electrically conductive terminal 16*a* and the second electrically conductive terminal 16*b* precisely corresponds to the target length L.

Thus, the electrical resistor 10 is suitable for being connected to external electronic components through the first electrically conductive terminal 16*a* and the second electrically conductive terminal 16*b* and for working as a passive circuit element having an electrical resistance corresponding to the target electrical resistance.

In the embodiment shown in FIG. 2, the first electrically conductive terminal 16*a* and the second electrically conductive terminal 16*b* have outermost ends along the first direction that coincide with the outermost ends along the first direction of the electrically resistive layer 14, so that neither the first electrically conductive terminal 16*a* nor the second electrically conductive terminal 16*b* extend along the first direction beyond the electrically resistive layer 14. However, in other embodiments of the invention, as e.g. that shown in FIG. 3, the first electrically conductive terminal 16*a* and the second electrically conductive terminal 16 be may extend along the first direction beyond the electrically resistive layer 14. It will be hence clear to those skilled in the art that the present invention is not restricted to any particular geometrical configuration of the first electrically conductive terminal 16*a* and the second electrically conductive terminal 16*b* with respect to the electrically resistive layer 14, as long as the separation between the first electrically conductive terminal 16*a* and the second electrically conductive terminal 16*b* along the first direction corresponds to the target length L.

Figure 4:
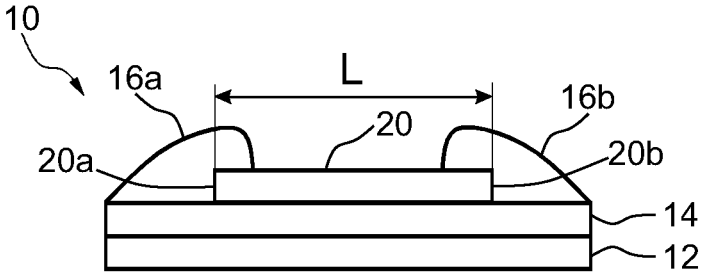
FIG. 4 shows an electrical resistor formed by a method according to another embodiment of the invention.
Figure 5:
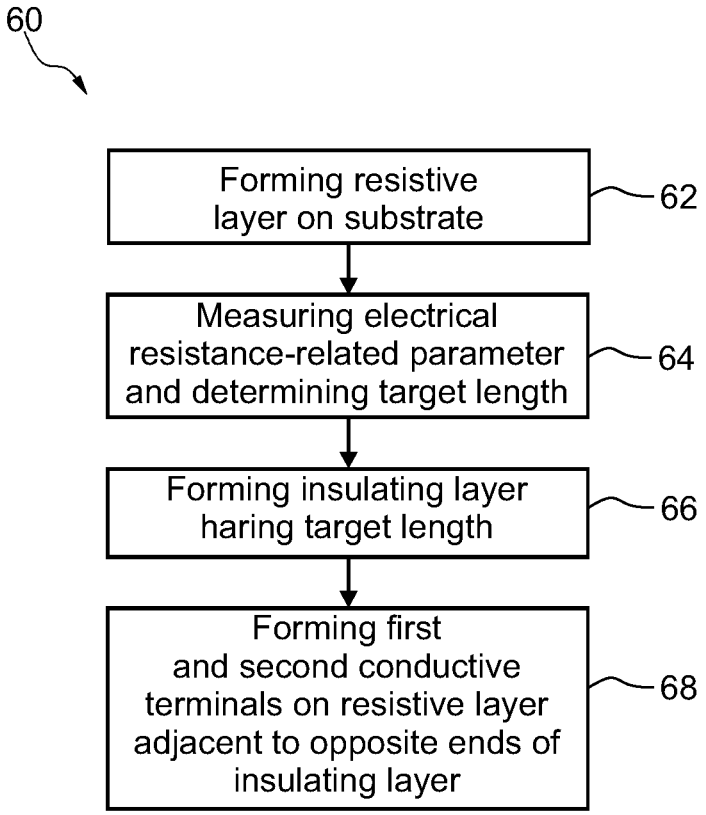
FIG. 5 is a flow diagram representing a method for forming an electrical resistor according to another embodiment of the invention.

FIG. 5 is a flow diagram illustrating a method 60 of forming an electrical resistor having a target electrical resistance by additive manufacturing according to an embodiment of the invention. An exemplary electrical resistor 10 formed by the method 60 illustrated in FIG. 5 is shown in FIG. 4. Thus, FIGS. 4 and 5 may be considered in combination for a better understanding of the invention. The method 60 comprises a step 62 of forming an electrically resistive layer 14 on a substrate 12. In the embodiment shown, the step 62 comprises coating an electrically resistive layer 14 of carbon having a thickness of 15 μm on the substrate 12, which in the embodiment shown corresponds to a ceramic substrate 12, and subsequently drying the electrically resistive layer 14.

The method 60 further comprises a step 64 of measuring an electrical resistance-related parameter of the electrically resistive layer 14 along a first direction and determining from the electrical resistance-related parameter a target length L of the electrically resistive layer 14 along the first direction corresponding to the target electrical resistance. Method step 64 of the method 60 illustrated in FIG. 5 is analogous to method step 54 of the method 50 illustrated in FIG. 1.

The method 60 further comprises a step 66 of forming an electrically isolating layer 20 on the electrically resistive layer 14 that extends along the first direction between a first end 20*a* and a second end 20*b* of the electrically isolating layer 20, wherein a distance between the first end 20*a* and the second end 20*b* along the first direction corresponds to the target length L. Therefore, an electrical resistance of a portion of the electrically resistive layer 14 covered by the electrically isolating layer 20 along the first direction corresponds to the target electrical resistance. In the embodiment shown, the electrically isolating layer 20 is formed on the electrically resistive layer 14 by means of screen printing using a printing screen or mask corresponding to a negative image of the electrically isolating layer 20 having a length precisely corresponding to the target length L. For example, an electrically resistive printing polymer fluid can be pressed though the printing screen onto the electrically resistive layer 14 so that an electrically isolating layer 20 made of a polymer is formed on the electrically resistive layer 14 having a length along the first direction precisely corresponding to the target length L.

The method 68 further comprises a step 68 of forming a first electrically conductive terminal 16*a* on the electrically resistive layer 14 directly adjacent to the first end 20*a* of the electrically isolating layer 20 and forming a second electrically conductive terminal 16*b* on the electrically resistive layer 14 directly adjacent to the second end 20*b* of the electrically isolating layer 20. The first electrically conductive terminal 16*a* and the second electrically conductive terminal 16*b* are separated along the first direction by the electrically isolating layer 20, which has a length that corresponds to the target length L. Consequently, an electrical path joining the first electrically conductive terminal 16*a* and the second electrically conductive terminal 16*b* extends through a portion of the electrically resistive layer 14 having a length corresponding to the target length L and hence an electrical resistance corresponding to the target electrical resistance. Thus, the electrical resistor 10 is suitable for being connected to external electronic components through the first electrically conductive terminal 16*a* and the second electrically conductive terminal 16*b* and for working as a passive circuit element having an electrical resistance corresponding to the target electrical resistance.

As shown in FIG. 4, the first electrically conductive terminal 16*a* and the second electrically conductive terminal 16*b* need not have a regular form nor be coplanar with the underlying electrically isolating layer 20 and electrically resistive layer 14. For example, the first electrically conductive terminal 16*a* and the second electrically conductive terminal 16*b* of the embodiment shown in FIG. 4 have an irregular form, extend over parts of the electrically resistive layer 14 not covered by the electrically isolating layer 20, and partly extend over the electrically isolating layer 20. In the embodiment of FIG. 4, the first and second electrically conductive terminals 16*a*, 16*b* are formed on the electrically resistive layer "directly adjacent to the first and second ends 20*a*, 20*b* of the electrically isolating layer 20" by having them overlap with the ends 20*a*, 20*b* of the electrically isolating layer 20. Accordingly, the electrically isolating layer 20 provides for the precise location where the electrically conductive terminals 16*a*, 16*b* contact the electrically resistive layer 14 without requiring a correspondingly precise positioning of the electrically conductive terminals 16*a*, 16*b* themselves. Accordingly, the only method step that needs to be carried out with high precision in this embodiment is the formation of the electrically isolating layer 20. Manufacturing imperfections e.g. with regard to the cross-section or electrical resistivity ρ of the electrically resistive layer 14 are absorbed in the proper choice of the target length, and a high precision with regard to forming the electrically conductive terminals 16*a*, 16*b* is likewise not necessary, since they may simply be formed such as to overlap with the corresponding end of the electrically isolating layer 20, which automatically ensures that they are formed on the electrically resistive layer 20 "directly adjacent to" the respective end of the electrically isolating layer 20.

Figure 6:
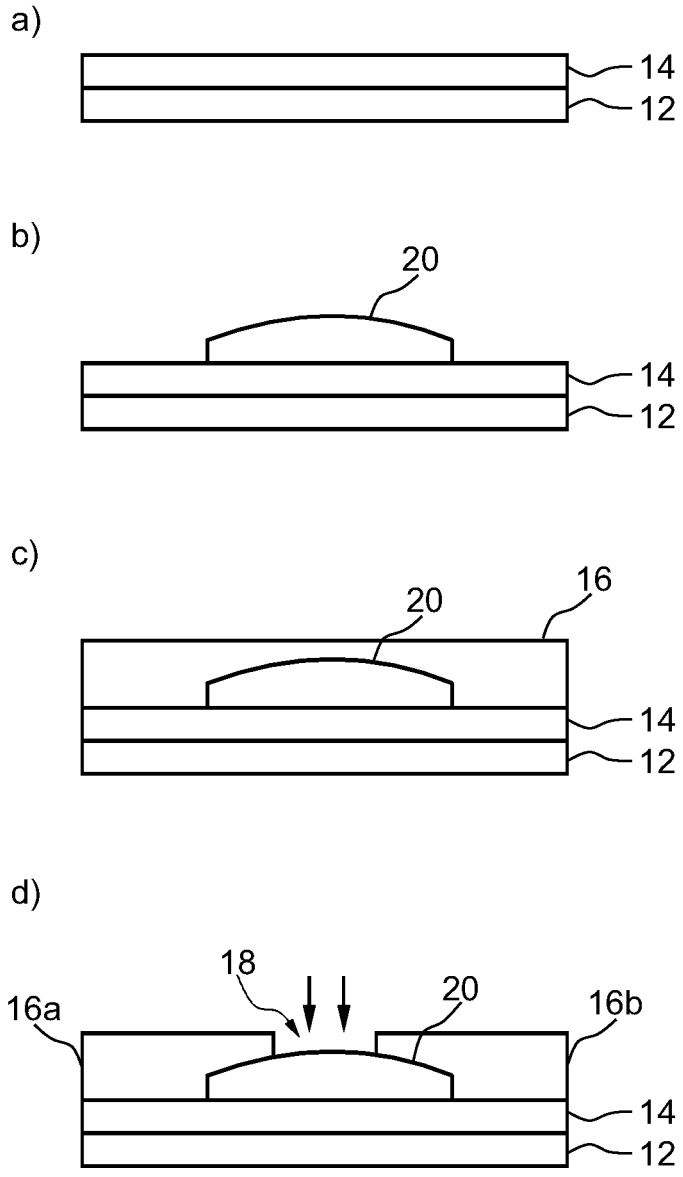
FIG. 6 illustrates a method for forming an electrical resistor according to an embodiment of the invention.

FIG. 6 illustrates different stages of a method for forming an electrical resistor 10 according to an embodiment of the invention. As shown in FIG. 6*a*, an electrically resistive layer 14 of carbon is coated on a substrate 12 and subsequently dried. The electrically resistive layer 14 can however also be made of metal oxides as tin oxide, PeDot and/or of mixtures thereof. In the embodiment shown, the electrically resistive layer 14 is conformably formed over the substrate 12 such that the electrically resistive layer 14 is coplanar with the substrate 12.

As shown in FIG. 6*b*, an electrically isolating layer 20 is formed on the electrically resistive layer 14. In the embodiment shown, the electrically isolating layer 20 is made of an organic polymer and is formed by screen printing. As shown in the figure, the electrically isolating layer 20 need not have a regular shape as long as it has a length along the first direction that precisely corresponds to the target length L. For example, in the embodiment shown, the electrically isolating layer 20 has a curved top surface that is not coplanar with the underlying electrically resistive layer 14.

As shown in FIG. 6*c*, an electrically conductive layer 16 is formed on the electrically isolating layer 20 and on parts of the electrically resistive layer 14 not covered by the electrically isolating layer 20. In the embodiment shown, the electrically conductive layer 16 is made of copper and is conformably formed over the electrically isolating layer 20 and on parts of the electrically resistive layer 14 not covered by the electrically isolating layer 20 by means of coating and subsequent drying.

As shown in FIG. 6*d*, an opening 18 is formed in the electrically conductive layer 16 that forms a discontinuity in the electrically conductive layer 16 and exposes the electrically isolating layer 20 through the electrically conductive layer 16. The electrically conductive layer 16 is thereby divided in a first electrically conductive terminal 16*a* and a second electrically conductive terminal 16*b* that are electrically isolated from each other, such that an electrical path between the first electrically conductive terminal 16*a* and the second electrically conductive terminal 16*b* extends through the electrically resistive layer 14. The process of forming the opening 18 does not require high precision, since the separation between the first electrically conductive terminal 16*a* and the second electrically conductive terminal 16*b* through the electrically resistive layer 14, i.e. the electrical path joining the first electrically conductive terminal 16*a* and the second electrically conductive terminal 16*b*, corresponds to the target length L irrespectively of a form or dimension of the opening 18. Thus a quality of the formation process of the opening 18 does not affect the accuracy with which the electrical resistor 10 achieves the target electrical resistance. In the embodiment shown, the opening 18 is formed by means of a fast mechanical erosion, like e.g. sawing, although other erosive processes can be used.

Figure 7:
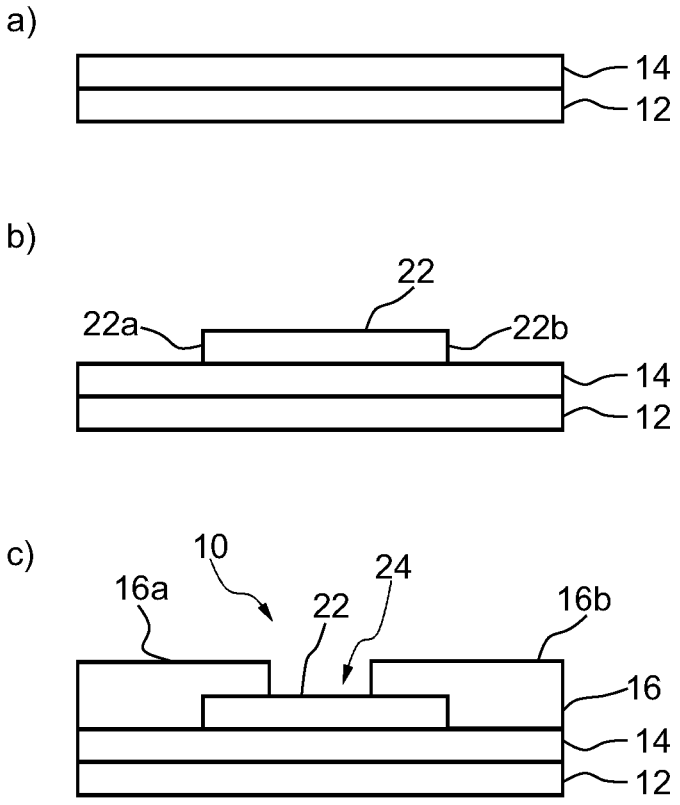
FIG. 7 illustrates a method for forming an electrical resistor according to another embodiment of the invention.

FIG. 7 illustrates different stages of a method for forming an electrical resistor 10 according to a further embodiment of the invention. As shown in FIG. 7*a*, an electrically resistive layer 14 is formed on a substrate 12. In the embodiment shown, the electrically resistive layer 14 is made of a polymer, like e.g. PE, PP, PET, OPA, PC or PVC, and is conformably printed on the substrate 12 by means of screen printing.

As shown in FIG. 7*b*, a prefabricated electrically isolating element 22 is deposited on the electrically resistive layer 14. The prefabricated electrically isolating element 22 extends from a first end 22*a* to a second end 22*b* along the first direction, wherein a distance between the first end 22*a* and a second end 22*b* corresponds to the target length L. In the embodiment shown, the prefabricated electrically isolating element 22 is a stripe made of an organic polymer that has a length corresponding to the target length L. The prefabricated electrically isolating element 22 is glued on the electrically resistive layer 14 and covers a portion of the electrically resistive layer 14 having a length corresponding to the target length L and hence having an electrical resistance corresponding to the target electrical resistance.

As shown in FIG. 7*c*, an electrically conductive layer 16 is formed on the prefabricated electrically isolating element 22 and parts of the electrically resistive layer 14 not covered by the prefabricated electrically isolating element 22. In the embodiment shown, the electrically conductive layer 16 is made of silver and is printed on the prefabricated electrically isolating element 22 and part of the electrically resistive layer 14 not covered by the prefabricated electrically isolating element 22 by means of inkjet printing. When printing the electrically conductive layer 16, the printing process is momentarily interrupted such that a discontinuity 24 is formed in the electrically conductive layer 16. Consequently, a first electrically conductive terminal 16*a* is formed adjacent to the first end 22*a* of the prefabricated electrically isolating element 22 and a second electrically conductive terminal 16*b* is formed adjacent to the second end 22*b* of the prefabricated electrically isolating element 22. Notably, the interruption of the printing process of the electrically conductive layer 16 for forming the discontinuity 24 does not require high precision, since the separation between the first electrically conductive terminal 16*a* and the second electrically conductive terminal 16*b* through the electrically resistive layer 14, i.e. the electrical path joining the first electrically conductive terminal 16*a* and the second electrically conductive terminal 16*b*, corresponds to the target length L irrespectively of a form or dimension of the discontinuity 24. Thus a quality of the interruption, like e.g. a spatial or time resolution thereof, does not affect the accuracy with which the electrical resistor 10 achieves the target electrical resistance.

Figure 8:
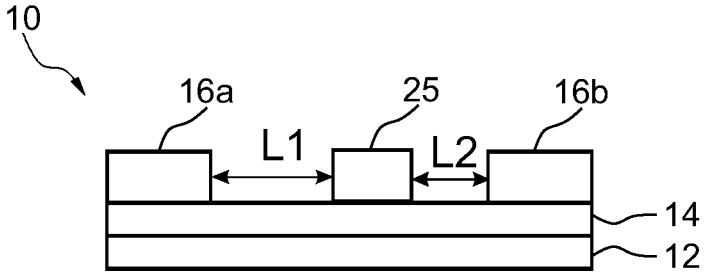
FIG. 8 illustrates an exemplary use of electrically conductive elements for reducing the length of the electrical path between the first and second electrically conductive terminals according to an embodiment of the invention.

FIG. 8 schematically shows how an electrically conductive element 25 may be used for reducing the length of the electrical path between the first and second electrically conductive terminals 16*a*, 16*b* according to an embodiment of the invention. As shown in the figure, an electrically conductive element 25 is electrically connected to the electrically resistive layer 14 between the first and second electrically conductive terminals 16*a*, 16*b*. Although only one electrically conductive element 25 is exemplarily shown in the figure, it is understood that more than one electrically conductive element 25 may be used. The electrically conductive element 25 is, in the embodiment shown, of the same material as the first and second electrically conductive terminals 16*a*, 16*b*, for example of copper. As a result, the electrically conductive element 25 allows for an electric current to flow through its interior with a negligible electrical resistance and hence shortcuts an electrical path joining the first and second electrically conductive terminal 16*a*, 16*b* such that the effective length of said electrical path is reduced as compared to a situation in which the electrically conductive element 25 would not be present, like for example that shown in FIG. 2. Consequently, the length of the electrical path through the electrically resistive layer 14 between the first and second electrically conductive terminals 16*a*, 16*b* does no longer correspond to a separation distance L between first and second electrically conductive terminals 16*a*, 16*b* (cf. FIG. 2) but instead to the sum of a length L1 between the first electrically conductive terminal 16*a* and the electrically conductive element 25 and a length L2 between the second electrically conductive terminal 16*b* and the electrically conductive element 25, which sum is smaller than the length L of FIG. 2, wherein the difference between the length L and the sum of the lengths L1 and L2 correspond to a length of the electrically conductive element 25. Thus, one or more electrically conductive elements 25 may be used for reducing an electrical resistance value of the electrical resistor 10.

Figure 9:
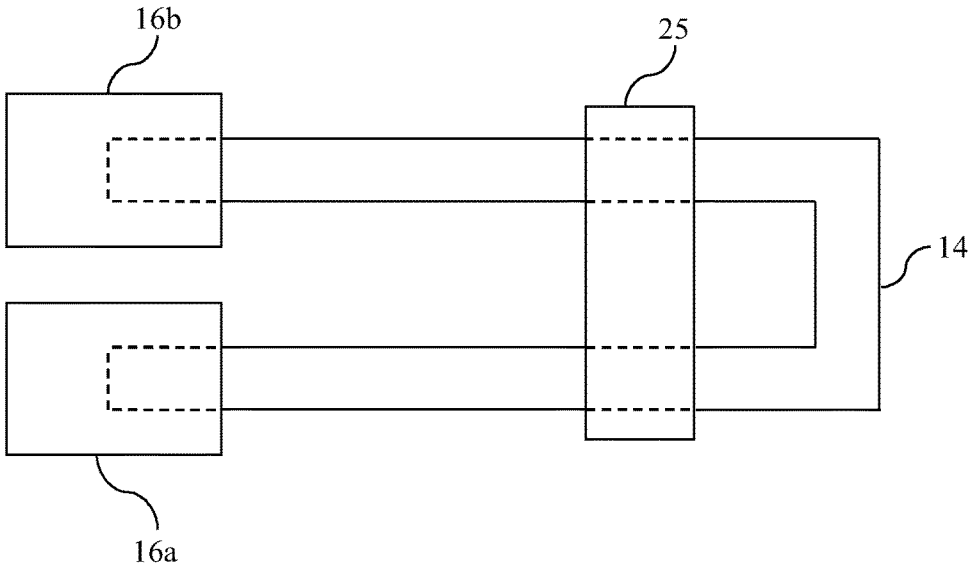
FIG. 9 illustrates another exemplary use of an electrically conductive element for reducing the length of the electrical path between the first and second electrically conductive terminals according to an embodiment of the invention.

FIG. 9 schematically illustrates another exemplary use of an electrically conductive element 25 for reducing the length of the electrical path between the first and second electrically conductive terminals 16*a*, 16*b* according to an embodiment of the invention. In this case, the electrically resistive layer 14 has a folded U-shape and so has the electrical path joining the first and second electrically conductive terminals 16*a*, 16*b*. The electrically conductive element 25 shortcuts this path such that the portion of the electrically resistive layer 14 illustrated in the figure to the right of the electrically conductive element 25 does no longer contribute to an effective length of the aforesaid electrical path. Thus the effective length of the electrical path between the first and second electrically conductive terminals 16*a*, 16*b* can be adjusted by conveniently positioning the electrically conductive element 25.

Figure 10:
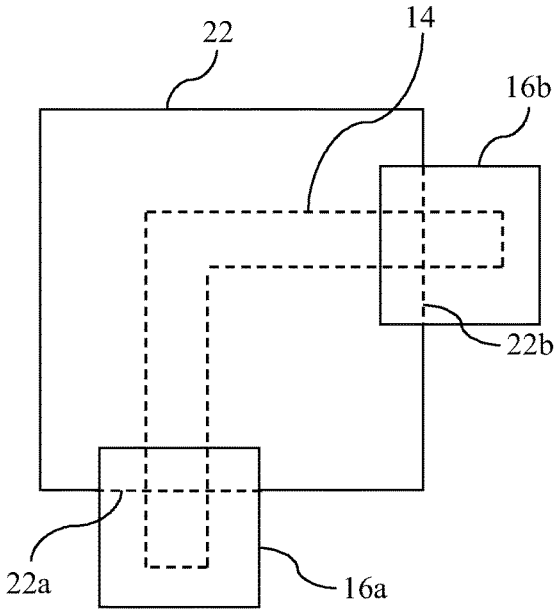
FIG. 10 illustrates an operation of adjusting the length of an electrically resistive layer covered by an electrically isolating element according to an embodiment of the invention.

FIG. 10 schematically illustrates an operation of adjusting the length of an electrically resistive layer 14 covered by an electrically isolating element 22 acting as an electrically isolating layer 20 according to an embodiment of the invention. In the embodiment shown, the electrically resistive layer 14 is formed having an angled shape, more precisely an L-shape. The electrically isolating element 22 is then deposited on the electrically resistive layer 14 such that a length of the electrically resistive layer 14 covered by the electrically isolating element 22 corresponds to the target length L which has previously been determined. The aforesaid length, which is L-shaped according to the form of the electrically resistive layer 14 can be adjusted by positioning the electrically isolating element 22 with respect to the electrically resistive layer 14, for example by shifting the electrically isolating element 22 along the direction corresponding to the horizontal direction in the figure.

The electrically isolating element 22 then covers the electrically resistive layer 14 in an overlapping region, which is correspondingly L-shaped and extends between a first end 22*a* and a second end 22*b* of the electrically isolating element 22. Subsequently, the first electrically conductive terminal 16*a* is formed adjacent to the first end 22*a* of the electrically isolating element 22 and the second electrically conductive terminal 16*b* is formed adjacent to the second end 22*b* of the electrically isolating element 22. The first and second electrically conductive terminals 16*a*, 16*b* partly overlap the electrically isolating element 22.

Figure 11:
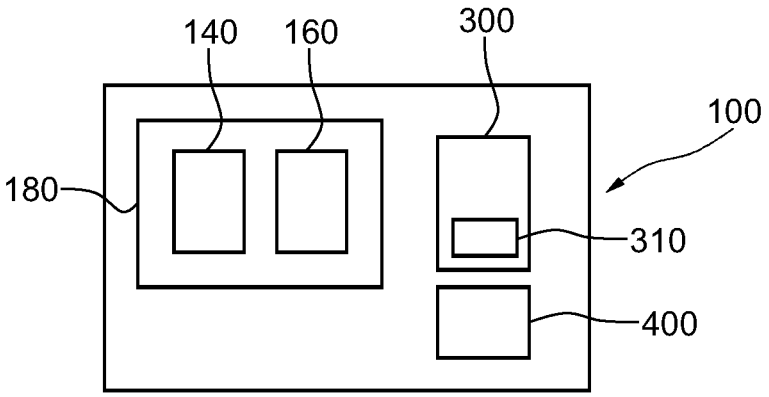
FIG. 11 shows an arrangement for forming an electrical resistor according to an embodiment of the invention.

FIG. 11 shows a schematic view of an arrangement 100 according to an embodiment of the invention for forming an electrical resistor having a target electrical resistance by additive manufacturing. The arrangement 100 comprises a first deposition device 140 and a second deposition device 160 that are integrated in a combined deposition device 180. In the embodiment shown, the first deposition device 140 comprises a printing device configured for forming an electrically resistive layer 14 by screen printing, and the second deposition device 160 comprises a further printing device configured for inkjet printing a first electrically conductive terminal 16*a* and a second electrically conductive terminal 16*b* or an electrically conductive layer 16 according to the embodiments described above on the electrically resistive layer 14 formed by the first deposition device 140.

The arrangement 100 further comprises a processing unit 300 that is configured for measuring an electrical resistance-related parameter of an electrically resistive layer 14 formed by the first deposition device 140 along a first direction and for determining from the electrical resistance-related parameter a target length L of the electrically resistive layer 14 along the first direction corresponding to the target electrical resistance. In the embodiment shown, the processing unit 300 comprises a software tool configured for accurately controlling the printing of the first electrically conductive terminal 16*a* and the second electrically conductive terminal 16*a* by the second deposition device 160 such that a distance between them precisely corresponds to the target length L. Further, the processing unit 300 comprises a measuring device 310 suitable for measuring the electrical resistance-related parameter. For example, the measuring device 310 may comprise an ohmmeter and/or means for determining a length of the electrically resistive layer 14 along the first direction. In the embodiment shown, the measuring device 310 is suitable for measuring a final electrical resistance-related parameter.

The arrangement 100 further comprises an optical device 400, which in the embodiment shown comprises a photographic camera. The optical device 400 is configured for monitoring and tracking the formation of the first electrically conductive terminal 16*a* and the second electrically conductive terminal 16*b* by the second deposition device 160 and for providing information about the corresponding formation process to the processing unit 300.

Figure 12:
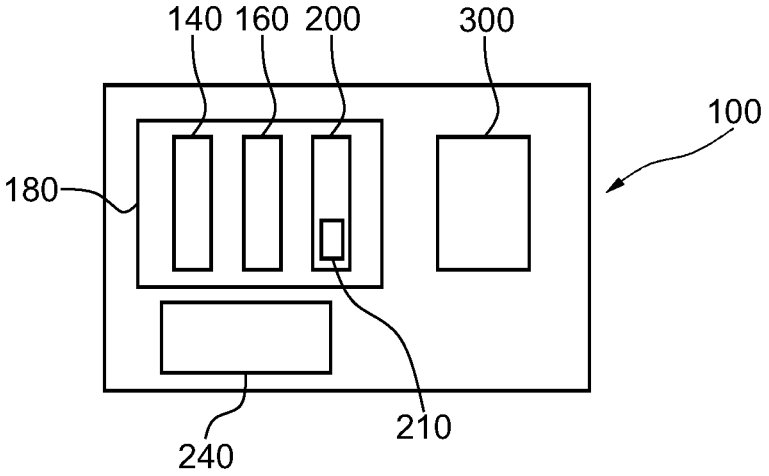
FIG. 12 shows an arrangement for forming an electrical resistor according to another embodiment of the invention.

FIG. 12 shows a schematic view of an arrangement 100 according to another embodiment of the invention for forming an electrical resistor having a target electrical resistance by additive manufacturing. The arrangement 100 comprises a first deposition device 140, a second position device 160, and a third deposition device 200. The first deposition device 140 and the second deposition device 160 correspond to the first deposition device 140 and the second deposition device 160 of the embodiment shown in FIG. 11. The third deposition device 200 comprises a robot device 210 configured for depositing a prefabricated electrically isolating element 22 on an electrically resistive layer 14 formed by the first deposition device 140 according to corresponding embodiments of the invention described above. The arrangement 100 further comprises a processing unit 300 controlling all of its components.

The arrangement 100 further comprises a subtractive device 240 configured for forming an opening in an electrically conductive layer 16 formed by the second deposition device 160 according to corresponding embodiments of the invention described above.

Although preferred exemplary embodiments are shown and specified in detail in the drawings and the preceding specification, these should be viewed as purely exemplary and not as limiting the invention. It is noted in this regard that only the preferred exemplary embodiments are shown and specified, and all variations and modifications should be protected that presently or in the future lie within the scope of protection of the invention as defined in the claims.

The invention claimed is:

1. A method of forming an electrical resistor having a target electrical resistance by additive manufacturing comprising the steps of:

forming an electrically resistive layer on a substrate;

measuring an electrical resistance-related parameter of the electrically resistive layer and determining from the electrical resistance-related parameter a target length of the electrically resistive layer corresponding to the target electrical resistance; and forming a first electrically conductive terminal and a second electrically conductive terminal contacting the electrically resistive layer, said first and second electrically conductive terminals being separated by a distance corresponding to the target length, such that an electrical resistance of a portion of the electrically resistive layer extending between the first electrically conductive terminal and the second electrically conductive terminal corresponds to the target electrical resistance.

2. The method of forming an electrical resistor of claim 1, wherein the electrically resistive layer is made of carbon, carbon composites, metal oxides, and/or mixtures thereof.

3. The method of forming an electrical resistor of claim 1, wherein forming the electrically resistive layer comprises one or more of printing, coating, vacuum coating, vacuum deposition, curing and drying.

4. The method of forming an electrical resistor of claim 1, wherein forming the first electrically conductive terminal and the second electrically conductive terminal layer comprises digital inkjet printing, digital thermo transfer printing, or digital 3-D printing.

5. The method of forming an electrical resistor of claim 1, wherein the electrical resistance-related parameter is determined by measuring an electrical resistance of a portion of the electrically resistive layer having a known length.

6. The method of forming an electrical resistor of claim 1, further comprising electrically connecting to the electrically resistive layer between the first electrically conductive terminal and the second electrically conductive terminal one or more electrically conductive elements.

7. The method of forming an electrical resistor of claim 1, further comprising measuring a final electrical resistance-related parameter of the electrically resistive layer between the first electrically conductive terminal and the second electrically conductive terminal, wherein the final electrical resistance-related parameter is indicative of an electrical resistance of the electrically resistive layer between the first electrically conductive terminal and the second electrically conductive terminal.

8. The method of forming an electrical resistor of claim 1, further comprising optically monitoring the formation of the first electrically conductive terminal and the second electrically conductive terminal.

9. The method of forming an electrical resistor of claim 1, further comprising optically monitoring the formation of the electrically isolating layer.

10. The method of forming an electrical resistor of claim 1, wherein the substrate comprises a silicon substrate, a polymer substrate, a ceramic substrate, a printed circuit board, a paper substrate or a cardboard substrate.

11. A method of forming an electrical resistor having a target electrical resistance by additive manufacturing comprising the steps of:

forming an electrically resistive layer on a substrate;

measuring an electrical resistance-related parameter of the electrically resistive layer and determining from the electrical resistance-related parameter a target length of the electrically resistive layer corresponding to the target electrical resistance;

forming an electrically isolating layer on the electrically resistive layer having first and second ends, wherein the electrically isolating layer covers the electrically resistive layer in an overlap region extending between said first end and said second end, such that a length of the electrically resistive layer covered by the electrically isolating layer corresponds to the target length, such that an electrical resistance of a portion of the electrically resistive layer covered by the electrically isolating layer corresponds to the target electrical resistance; and forming a first electrically conductive terminal on the electrically resistive layer directly adjacent to the first end of the electrically isolating layer and forming a second electrically conductive terminal on the electrically resistive layer directly adjacent to the second end of the electrically isolating layer.

12. The method of forming an electrical resistor of claim 11, wherein the electrically isolating layer is made of a ceramic, silicon oxide, aluminum oxide or metallic oxide, paper, or an organic polymer.

13. The method of forming an electrical resistor of claim 11, wherein forming the electrically isolating layer comprises one or more of analog screen printing, analog flexo printing, analog gravure printing, analog inkjet printing, analog pad printing, analog hot stamping, analog thermo transfer printing, and analog 3-D printing.

14. The method of forming an electrical resistor of claim 11, wherein the electrically isolating layer is formed by depositing an electrically isolating element on the electrically resistive layer.

15. The method of claim 14, further comprising adjusting the length of the electrically resistive layer covered by the electrically isolating element by positioning the electrically isolating element with respect to the electrically resistive layer.

16. The method of forming an electrical resistor of claim 11, wherein forming the first electrically conductive terminal and the second electrically conductive terminal comprises forming an electrically conductive layer on the electrically isolating layer and on parts of the electrically resistive layer not covered by the electrically isolating layer, wherein the electrically conductive layer has a discontinuity that electrically isolates the first electrically conductive terminal from the second electrically conductive terminal.

17. Arrangement for forming an electrical resistor having a target electrical resistance by additive manufacturing, wherein the arrangement comprises:

a first deposition device configured for depositing an electrically resistive material for forming an electrically resistive layer;

a processing unit configured for measuring an electrical resistance-related parameter of an electrically resistive layer formed by the first deposition device and determining from the electrical resistance-related parameter a target length of the electrically resistive layer corresponding to the target electrical resistance; and a second deposition device configured for depositing an electrically conductive material for forming electrically conductive terminals;

wherein the processing unit is further configured for controlling the second deposition device to form a first electrically conductive terminal and a second electrically conductive terminal such as to contact an electrically resistive layer formed by the first deposition device, said first and second electrically conductive terminals being separated by a distance corresponding to the target length, such that an electrical resistance of a portion of the electrically resistive layer extending between the first electrically conductive terminal and the second electrically conductive terminal corresponds to the target electrical resistance.

18. The arrangement of claim 17, wherein the second deposition device comprises a printing device configured for printing the first electrically conductive terminal and the second electrically conductive terminal by means of inkjet printing, thermo transfer printing, or 3-D printing.

19. The arrangement of claim 17, further comprising an optical device configured for optically monitoring the formation of the first electrically conductive terminal and the second electrically conductive terminal by the second deposition device and/or for optically monitoring the formation of the electrically isolating layer by the third deposition device.

20. The arrangement of claim 17, further comprising a measuring device suitable for measuring an electrical resistance-related parameter of the electrically resistive layer.

21. Arrangement for forming an electrical resistor having a target electrical resistance by additive manufacturing, wherein the arrangement comprises:

a first deposition device configured for depositing an electrically resistive material for forming an electrically resistive layer;

a processing unit configured for measuring an electrical resistance-related parameter of an electrically resistive layer formed by the first deposition device and determining from the electrical resistance-related parameter a target length of the electrically resistive layer corresponding to the target electrical resistance;

a second deposition device configured for depositing an electrically conductive material for forming electrically conductive terminals; and a third deposition device configured for depositing an electrically isolating material for forming an electrically isolating layer;

wherein the processing unit is further configured for controlling the third deposition device to form the electrically isolating layer on an electrically resistive layer formed by the first deposition device, such that the electrically isolating layer extends from a first end to a second end, wherein the electrically isolating layer covers the electrically resistive layer in an overlap region extending between said first end and said second end, such that a length of the electrically resistive layer covered by the electrically isolating layer corresponds to the target length; and wherein the processing unit is further configured for controlling the second deposition device to form a first electrically conductive terminal on the electrically resistive layer directly adjacent to the first end of the electrically isolating layer and to form a second electrically conductive terminal on the electrically resistive layer directly adjacent to the second end of the electrically isolating layer.

22. The arrangement of forming an electrical resistor of claim 21, wherein the third deposition device comprises a robot device configured for depositing a prefabricated electrically isolating element on an electrically resistive layer formed by the first deposition device, wherein the electrically isolating element extends from a first end to a second end, wherein a distance between the first end and the second end corresponds to the target length, such that an electrical resistance of a portion of the electrically resistive layer covered by the electrically isolating element corresponds to the target electrical resistance.

23. The arrangement of forming an electrical resistor of claim 21, wherein the third deposition device comprises a printing device configured for printing the electrically isolating layer by means of analog screen printing, analog flexo printing, analog gravure printing, analog inkjet printing, analog pad printing, hot stamping, and analog thermo transfer printing.

24. The arrangement of claim 21, wherein the third deposition device comprises a printing device configured for printing the electrically isolating layer by means of digital inkjet printing, digital thermo transfer printing, or digital 3-D printing.

25. The arrangement of claim 21, further comprising a subtractive device suitable for forming a discontinuity in an electrically conductive layer formed by the second deposition device on the electrically isolating layer to thereby form the first electrically conductive terminal and the second electrically conductive terminal, such that the first electrically conductive terminal and the second electrically conductive terminal are electrically isolated from each other.

* * * * *